US005259792A

United States Patent [19]

Beck et al.

[11] Patent Number: 5,259,792

[45] Date of Patent: Nov. 9, 1993

[54] ELECTRICAL CONNECTOR HOUSING AND METHOD FOR MINIMIZING EMI EMISSIONS

[75] Inventors: Herbert C. Beck, Simpsonville; Sam S. Shasteen, Greenville, both of S.C.

[73] Assignee: Woven Electronics, Simpsonville, S.C.

[21] Appl. No.: 887,890

[22] Filed: May 26, 1992

[51] Int. Cl.[5] ..... H01R 13/648

[52] U.S. Cl. ..... 439/607; 439/906

[58] Field of Search ..... 439/607, 608, 610, 731, 439/906, 931; 174/117 F

[56] References Cited

U.S. PATENT DOCUMENTS

| | | | |
|---|---|---|---|
| 3,670,289 | 6/1972 | Bruner | 439/731 X |
| 3,848,959 | 11/1974 | Parlato | 439/731 X |
| 4,719,321 | 1/1988 | Kozel et al. | 439/731 X |
| 4,721,483 | 1/1988 | Dickie | 439/610 |

FOREIGN PATENT DOCUMENTS

| | | | |
|---|---|---|---|
| 0090539 | 5/1983 | European Pat. Off. | 439/906 |
| 0299178 | 12/1990 | Japan | 439/731 |

*Primary Examiner*—Larry I. Schwartz
*Assistant Examiner*—Khiem Nguyen
*Attorney, Agent, or Firm*—Cort Flint

[57] ABSTRACT

A connector housing and method for minimizing EMI emissions from an electrical transmission cable is disclosed which includes providing a series of interrupt elements in each half of the connector housing which interlock together when the halves are clamped together about the electrical transmission cable. The interrupt elements provide discontinuity along the length of the interface joint which reduces the emission of interference signals from the housing. Preferably the housing connector and interference elements are molded from plastic material and plated with a metallic shield material.

19 Claims, 2 Drawing Sheets

ELECTRICAL CONNECTOR HOUSING AND METHOD FOR MINIMIZING EMI EMISSIONS

BACKGROUND OF THE INVENTION

The invention relates to a connector housing for an electrical transmission cable, and more particularly, to the provision of such a connector housing which minimizes electromagnetic interference emissions from the housing.

Heretofore connector housings have been provided for flat electrical transmission cables having a plurality of conductors arranged in a side by side manner such as shown in U.S. Pat. No. 4,721,483. Typically, connector housings of the aforesaid type include a top shell half and a bottom shell half which define a groove joint around at least a portion of the housing when the top and bottom halves are fitted together. While the top and bottom halves of the cover assembly are typically shielded, the electromagnetic and radio frequency interference may be emitted from the groove joint. The flat ribbon-type electrical transmission cables terminated in the connector housings have a high density of small diameter signal transmitting wires arranged generally side-by-side. It is desirable to provide as much shielding of the cable and connector housing as possible to reduce interference with the associated circuitry with which the cable is used.

Accordingly, an object of the invention is to minimize electromagnetic and radio frequency interferences emitted from a connector housing from a ribbon-type transmission cable.

Another object of the invention is to provide a connector housing having a top and bottom half that fit together to enclose a terminal end of a ribbon-type electrical transmission cable and include an interlock which minimizes emissions of interference signals from the housing.

SUMMARY OF THE INVENTION

The above objectives are accomplished according to the present invention by providing a connector housing for a flat ribbon-type electrical transmission cable having a top half and a bottom half which are fitted together with an interlock joint which minimizes the emittance of electromagnetic interference (EMI) through the joint. The interlock is provided by a number of interrupt elements that provide discontinuity along the otherwise continuous line joint. The discontinuity of the groove minimizes the emissions of the interference signals. Preferably, the interlock along the interface between the top and bottom connector housing halves is provided by serrations in the form of triangular teeth that fit together. The teeth interlock so that there is insufficient space to allow for the transmission of EMI at frequencies at least up to six gigahertz. However, the interrupt may be provided in the form of other elements as long as there is no space having a linear dimension greater than $\frac{1}{8}$ of the EMI wavelength.

DESCRIPTION OF THE DRAWINGS

The construction designed to carry out the invention will hereinafter be described. together with other features thereof. The invention will be more readily understood from a reading of the following specification and by reference to the accompanying drawings forming a part thereof, wherein an example of the invention is shown and wherein.

DESCRIPTION OF PREFERRED EMBODIMENT

Figure 1:
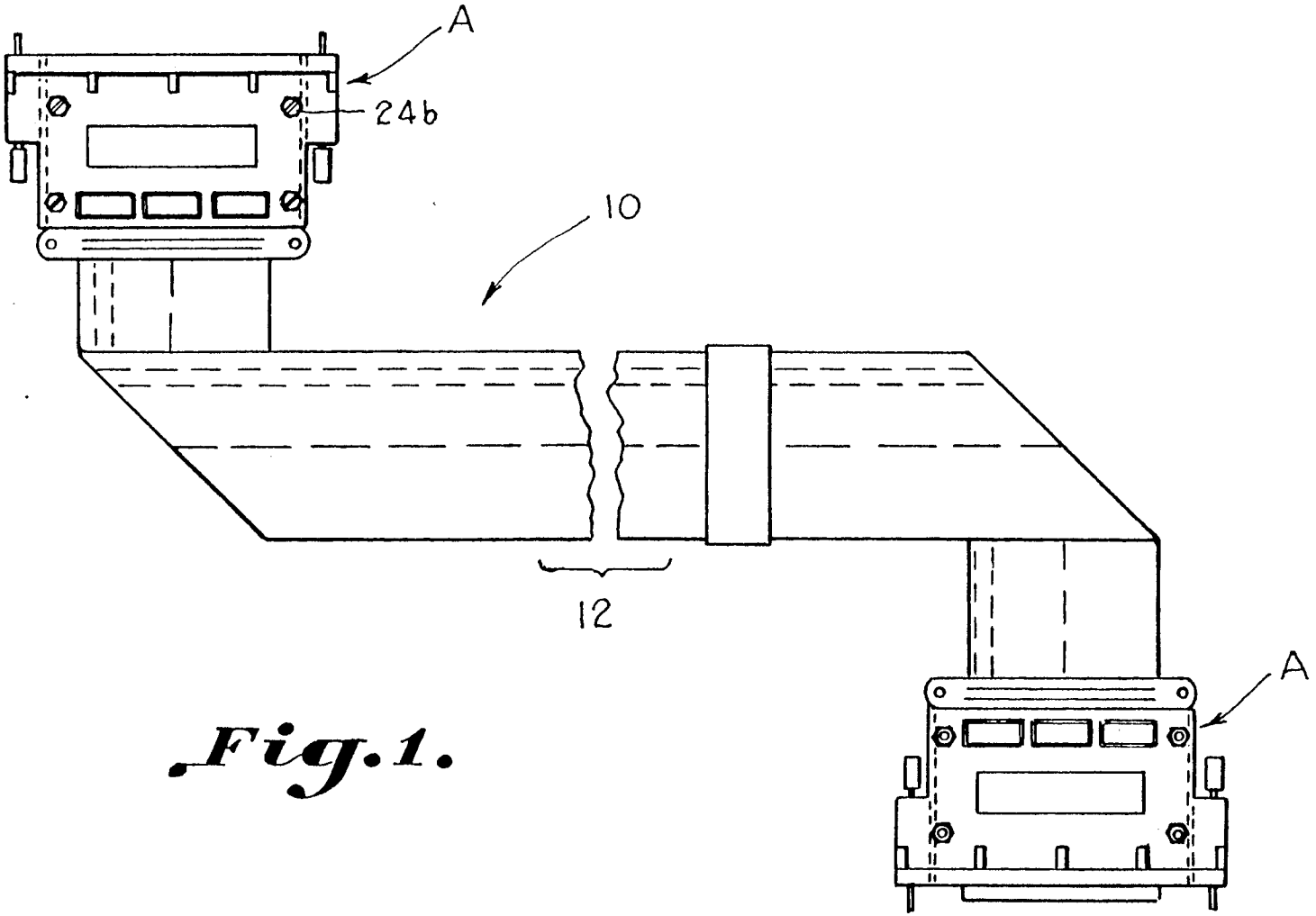
FIG. 1 is a top plain view of a flat ribbon-type electrical transmission cable incorporating connector housings constructed according to the invention.
Figures 2, 3:
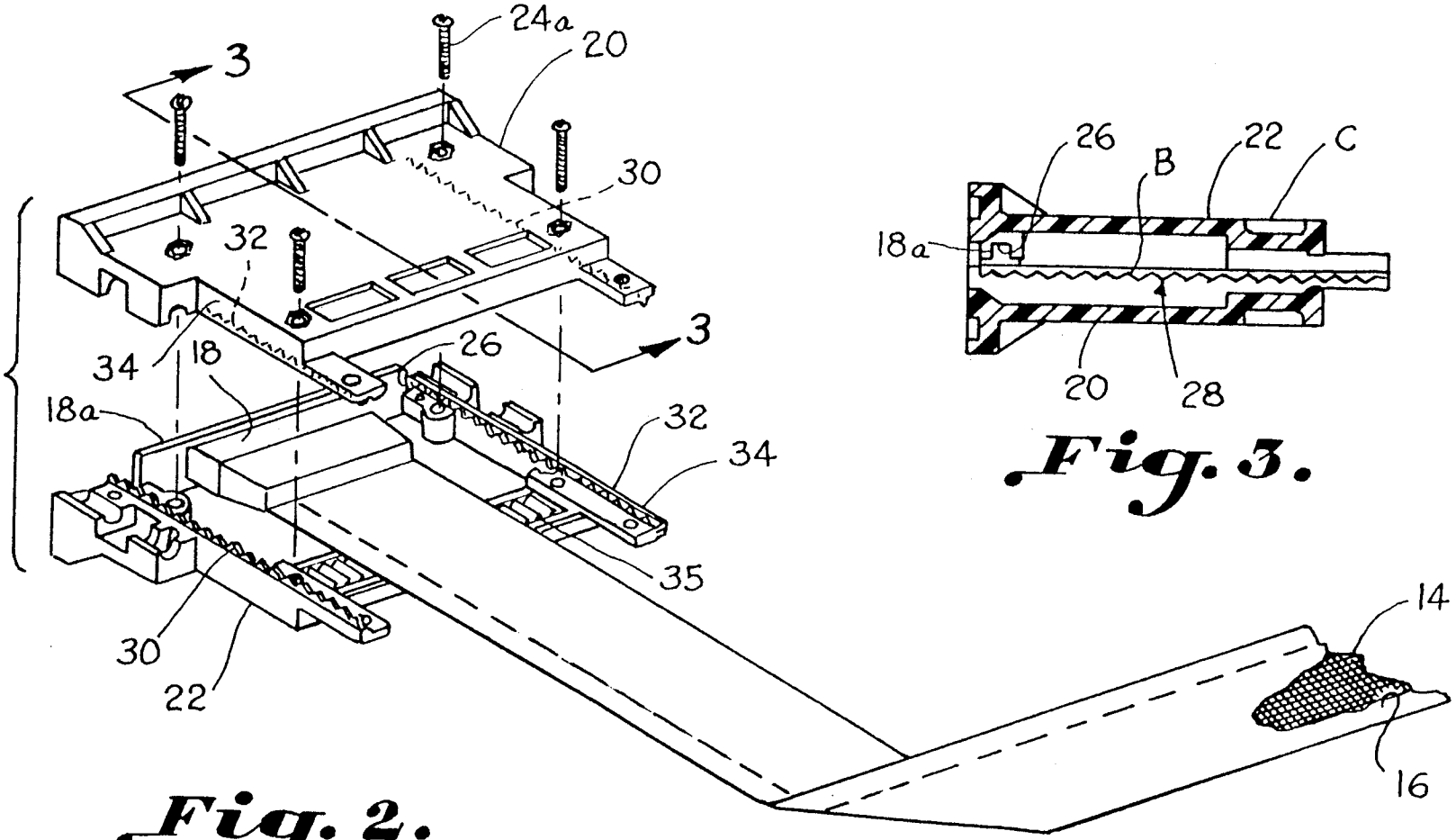
FIG. 2 is a perspective view illustrating a connector housing with a top housing half and a bottom housing half separated.
FIG. 3 is a sectional view taken along line 3—3 of FIG. 2.

Referring now to the drawings, a preferred embodiment of the invention will be described for a connector housing, designated generally as A. It can best be seen in FIG. 1, an electrical transmission cable assembly designated generally as 10 includes a flat ribbon-type electrical transmission cable 12 which may be a woven electrical transmission cable designated schematically as 14 which is wrapped with a foil metal shield 16, and an optional insulating jacket, such as PVC, as can best be seen in FIG. 2. A woven electrical transmission cable 14 may be any suitable woven electrical transmission cable such as shown in U.S. Pat. No. 4,143,236, or the cable may have a construction that it shown in U.S. Pat. No. 4,721,483. On each end of the electrical transmission cable 12 there is a connector housing A which is identical in which the opposing ends of the electrical transmission cable are terminated in a conventional manner such as soldering the ends of the signal transmitting wires to printed circuit boards that are electrically attached to multi-pin connectors 18 (FIG. 2). In accordance with the preferred embodiment connector housing A is provided in two parts, a top half 20 and a bottom half 22. The top and bottom halves of the connector housing are hermaphroditic (parts are identical). The top and bottom halves are clamped together by means of screws 24*a* and nuts 24*b*. Integral with multi-pin connector 18 is an element 18*a* which fits into slots 26 formed in the front of the top and bottom halves. These elements on each end of the connector are used to interface with mating features of the connector housing. The intermating of these features captures and locates the connector within the halves of the connector housings. With the top and bottom halves clamped together, the flange 18*a* and hence the multi-pin connector 18 are clamped together and positioned for insertion into associated electrical equipment. In practice, one or more cables 14 may be stacked on top of each other and terminated to a like number of printed circuit boards attached to multi-pin connector 18.

As can best be seen in FIGS. 2 and 3 an interface joint designated generally as 28, between top and bottom halves 22 and 20 includes interrupt means B for interrupting the otherwise continuous linear joint or groove found in conventional connector housings. The groove is made discontinuous as opposed to the continuous, uninterrupted groove found in the prior art. In the preferred embodiment, the interrupt means is provided by a plurality of serrated teeth wherein each housing A includes a series of projecting serrated teeth 30 and recessed serrated teeth 32. The serrated teeth in the respective housing halves are mirror images of one another. That is the projecting serrated teeth 30 interlock with the recessed serrated teeth 32 on opposing sides of the mated connector halves. Since serrated teeth 32 are recessed behind an outer wall 34 of the housing the typical straight joint is seen from the outside of the mated connector halves. Behind the outer wall 34 is the interlocking serrated teeth which provide interrupts in the continuous joint. The rows of serrated teeth B extend from the front of the housing to the rear of the housing as can best be seen in FIG. 3. While, serrated teeth are illustrated in the preferred embodiment, it is understood that other means of interrupting and providing discrete joint segments in the otherwise continuous groove can be provided. For example, gear teeth, or post or bars may extend along the joint and provide an interlock between the opposing housing halves along the length of the sides of the housing. The space between interrupt elements must be limited in order to prevent the emission of EMI emissions. Preferably, the space between the interrupt elements in the groove is limited to less than ⅛ of the wavelength of the emissions being minimized, RFI, or other EMI, etc.

Preferably, connector housing halves 20 and 22 are molded from a suitable plastic material with the interrupt elements B likewise being molded in an advantageous manner. Any suitable plastic may be used such as a ULTEM ® brand plastic available from the General Electric Company, or suitable ABS plastic. The plastic housing halves are plated with a metal plating shield C, such as a copper-nickel alloy, to provide shielding. The unique interlock feature of the present invention molded into the housing parts eliminates the labor and material associated with the various prior art means of sealing the joint between the housing parts such as hand soldering in the case of metal shells, expensive gaskets or the hand application of copper tape to minimize emissions. The present invention also provides the advantage that a metal plated plastic housing may be used rather than expensive metal parts. RFI shielding strips 35 are affixed to each housing half 20, 22, such that when the housing halves are clamped together the shielding strips 35 will make positive electrical contact with the cable foil metal shield 16. The shielding strips 35 also make positive electrical contact with the metalized plating shield C, on the inside surface of the housings 20, 22, providing continuous EMI/RFI shielding of the entire cable assembly 10, between the connectors 18 at each extremity of the cable assembly 10. The invention minimizes the EMI/RFI emissions typically associated with such housing structures.

While a preferred embodiment of the invention has been described using specific terms, such description is for illustrative purposes only, and it is to be understood that changes and variations may be made without departing from the spirit or scope of the following claims.

What is claimed is:

1. A conductor housing for a multi-pin connector of a flat multi-conductor cable comprising;

a first housing half;

a second housing half mating with said first housing half which, when mated in a clamped position, forms a front opening;

said front opening being adapted to receive said multi-pin connector so that the front face of the multi-pin connector faces outward of the connector housing;

said first housing and said second housing half clamping together in a mated position to form a longitudinal interface joint along opposite sides of said mated connector housing generally transverse to said front opening; and interrupt means formed along a length of said interface joints which defines a plurality of discrete joint segments for minimizing emissions of interference radiation from said connector housing when said first and second housing halves are clamped together.

2. The apparatus of 1 wherein said interrupt means comprises a series of interrupt elements extending longitudinally along said interface joint.

3. The device of claim 2 wherein said interrupt elements comprise a series of serrated teeth which interlock together along said opposite sides of said connector housing.

4. The device of claim 3 wherein said first and second housing halves each include a projecting series of serrated teeth carried along said interface joint on a first side of said housing half, and a recessed series of serrated teeth carried along an interface joint along a second side of said housing half.

5. The device of claim 4 including an outer wall formed on an outside of said serrated teeth when said projecting and recessed serrated teeth are interlocked together.

6. The device of claim 2 wherein said interrupt elements are molded in said first and second housing halves.

7. The device of claim 6 wherein said first and second housing halves are molded from a polymeric material.

8. The device of claim 7 wherein the molded first and second housing halves are plated with a metal plating for shielding.

9. The device of claim 1 including shielding strips carried by said first housing half and said second housing half and extending between said opposite sides at a rear opening of said conductor housing through which said cable extends.

10. A conductor housing for a multi-pin connector of a flat multi-conductor cable comprising;

a molded first housing half;

a molded second housing half mating with said first housing half which, when mated in a clamped position;

said first housing half and said second housing half clamping together in a mated position to form a longitudinal interface joint along respective first and second opposite sides of said mated connector housing;

interrupt elements extending along said interface joints of said first and second sides of said connector housing minimizing emissions of electromagnetic interference from said connector housing when said first and second housing halves are mated together; and said interrupt elements interrupting said interface joints to define spaces along said interface joints which are less than a specified fraction of a wavelength of said emissions of electromagnetic interference to reduce said emissions.

11. The apparatus of claim 10 wherein said interrupt means comprises a series of said interrupt elements extending longitudinally along said interface joints.

12. The device of claim 10 wherein said interrupt elements comprise series of serrated teeth which interlock to define said prescribed spacing.

13. The device of claim 11 wherein said first and second housing halves each include a projecting series of serrated teeth carried along said interface joint on a first side of said housing half, and a recessed series of serrated teeth carried along an interface joint along a second side of said housing half.

14. The apparatus of claim 10 wherein said interrupt elements are molded in said first and second housing halves.

15. A method of minimizing electromagnetic interference emissions from a connector housing which terminates a flat electrical transmission cable, said connector housing being of the type having first and second interface joints defined along first and second sides of said connector housing, said method comprising:

making said first and second interface joints discontinuous by including interrupt elements along said first and second interface joints to define a plurality of discrete joint segments which minimize emissions of said electromagnetic interference through said interface joints of said housing.

16. The method in claim 15 including providing a series of interrupt elements spaced along the length of said interface joints.

17. The method of claim 16 wherein said interrupt elements are spaced less than $\frac{1}{8}$ of the wavelength of said electromagnetic interference emissions.

18. The method of claim 15 wherein said interrupt elements are provided by a series of molded serrated teeth which interlock along said first and second interface joints.

19. The method of claim 15 wherein said connector housing includes a pair of housing halves fitted together, and said interrupt elements and said housing halves are molded and said interrupt elements interlock together when said housing halves are fitted together.

* * * * *